US011285726B2

(12) United States Patent
Hirai et al.

(10) Patent No.: US 11,285,726 B2
(45) Date of Patent: Mar. 29, 2022

(54) LIQUID EJECTION HEAD AND LIQUID EJECTION APPARATUS

(71) Applicant: Brother Kogyo Kabushiki Kaisha, Nagoya (JP)

(72) Inventors: Keita Hirai, Nagoya (JP); Shohei Koide, Nagoya (JP); Keita Sugiura, Toyokawa (JP); Hiroshi Katayama, Toyoake (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/887,195

(22) Filed: May 29, 2020

(65) Prior Publication Data

US 2020/0376846 A1 Dec. 3, 2020

(30) Foreign Application Priority Data

Jun. 3, 2019 (JP) ..... JP2019-103638

(51) Int. Cl.
*B41J 2/175* (2006.01)
*B41J 2/045* (2006.01)
*B41J 2/14* (2006.01)

(52) U.S. Cl.
CPC ..... *B41J 2/175* (2013.01); *B41J 2/04563* (2013.01); *B41J 2/1433* (2013.01); *B41J 2002/14411* (2013.01); *B41J 2002/14419* (2013.01)

(58) Field of Classification Search
CPC ..... B41J 2202/12
See application file for complete search history.

(56) References Cited

U.S. PATENT DOCUMENTS 5,574,486 A * 11/1996 Whitlow ..... B41J 2/1606 205/646
2009/0213163 A1* 8/2009 Bansyo ..... B41J 2/175 347/17

(Continued)

FOREIGN PATENT DOCUMENTS

JP 2008-290292 A 12/2008
JP 2015-199181 A 11/2015
JP 2019181707 A * 10/2019

OTHER PUBLICATIONS

Machine generated English translation of JP2019181707 to Machida, "Liquid Discharge Head and Liquid Discharge Device"; translation generated via FIT database on Oct. 23, 2021; 32pp.*

*Primary Examiner* — Shelby L Fidler
(74) *Attorney, Agent, or Firm* — Banner & Witcoff, Ltd.

(57) ABSTRACT

A liquid ejection head includes a supply manifold, a return manifold, and individual channels each connected, at its upstream end, to the supply manifold and, at its downstream end, to the return manifold. Each of the individual channels communicates with a corresponding one of nozzles arranged in an array on a nozzle surface. The supply manifold and the return manifold extend in an extending direction along the nozzle array. The return manifold includes a lower portion located below the supply manifold to overlap the supply manifold in plan view orthogonal to the nozzle surface, and a standing portion located at at least one of opposite ends of the lower portion in the extending direction to be outside the supply manifold in plan view. The standing portion has a height to cover at least a portion of an end of the supply manifold when viewed in the extending direction.

20 Claims, 10 Drawing Sheets

(56) References Cited

U.S. PATENT DOCUMENTS

| | | | | |
|---|---|---|---|---|
| 2017/0151792 | A1 | 6/2017 | Kobayashi et al. | |
| 2019/0084303 | A1* | 3/2019 | Sugiura | B41J 2/1433 |

* cited by examiner

LIQUID EJECTION HEAD AND LIQUID EJECTION APPARATUS

CROSS-REFERENCE TO RELATED APPLICATION

This application claims priority from Japanese Patent Application No. 2019-103638 filed on Jun. 3, 2019, the content of which is incorporated herein by reference in its entirety.

TECHNICAL FIELD

Aspects of the disclosure relate to a liquid ejection head and a liquid ejection apparatus including the liquid ejection head.

BACKGROUND

In order to reduce the difference in ejection characteristic caused by the ink temperature, a known liquid ejection head includes a thermistor disposed at or near a channel, and an actuator configured to, upon receipt of a drive voltage changed based on the ink temperature detected by the thermistor, apply ejection energy to ink in a pressure chamber. In this case, it is preferable to position the thermistor immediately upstream of the pressure chamber to reduce the difference between the ink temperature detected by the thermistor and the actual temperature of ink flowing into the pressure chamber. However, the thermistor is not be allowed to be positioned in the liquid ejection head filled with densely arranged components and is forcibly positioned spaced apart from the pressure chamber. This structure may cause a considerable difference between the ink temperature detected by the thermistor and the actual temperature of ink which reaches the pressure chamber after cooling off in the channel.

Aiming at reducing temperature changes of ink in a channel, another known liquid ejection head includes a supply manifold and a return manifold through which ink is circulated between an ink tank and the liquid ejection head. The supply manifold is disposed above the return manifold. A lower portion of the supply manifold is covered by the return manifold so as to be protected from an external space.

SUMMARY

However, in the known liquid ejection head of the circulation type, it is desired to further reduce the difference between the ink temperature detected by a thermistor and the temperature of ink flowing into a pressure chamber because the ink is likely to cool off in a supply channel leading to the pressure chamber.

Aspects of the disclosure provide a liquid ejection head and a liquid ejection apparatus including the liquid ejection head, the liquid ejection head being configured to prevent or reduce, more than before, cooling of liquid before it reaches a pressure chamber.

According to one or more aspects of the disclosure, a liquid ejection head includes a supply manifold including a supply port through which liquid is supplied from an exterior, a return manifold including a return port through which liquid is discharged to the exterior, and a plurality of individual channels each connected, at an upstream end thereof, to the supply manifold and, at a downstream end thereof, to the return manifold. Each of the individual channels communicates with a corresponding one of nozzles arranged in an array on a nozzle surface. The supply manifold and the return manifold extend in an extending direction along the array of the nozzles. The return manifold includes a lower portion located below the supply manifold to overlap the supply manifold in plan view orthogonal to the nozzle surface, and a standing portion located at at least one of opposite ends of the lower portion in the extending direction to be outside the supply manifold in plan view. The standing portion has a height to cover at least a portion of an end of the supply manifold when viewed in the extending direction.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

Illustrative embodiments of the disclosure will be described with reference to the drawings. Liquid ejection heads to be described according to illustrative embodiments are merely examples and not limited thereto. Various changes, additions, and deletions may be applied in the illustrative embodiments without departing from the spirit and scope of the disclosure.

First Illustrative Embodiment

<Structure of Liquid Ejection Apparatus>

A liquid ejection apparatus 10 including a liquid ejection head 20 according to a first illustrative embodiment is configured to eject liquid, such as ink. Hereinafter, the liquid ejection apparatus 10 will be described by way of example as applied to, but not limited to, an inkjet printer.

Figure 1:
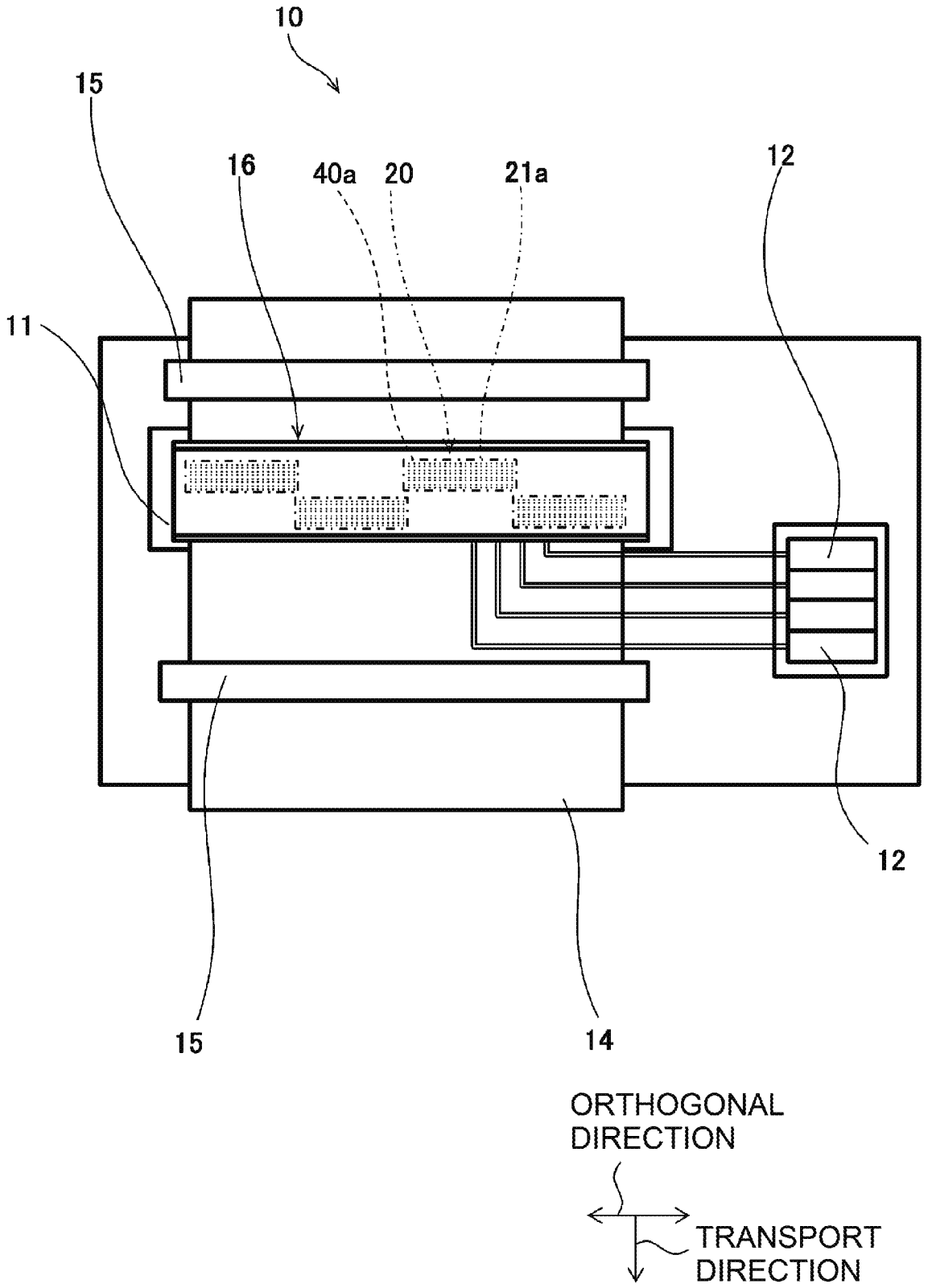
FIG. 1 is a plan view showing an overall structure of a liquid ejection apparatus including a liquid ejection head according to a first illustrative embodiment.

As shown in FIG. 1, the liquid ejection apparatus 10 employs a line head type and includes a platen 11, a transport unit, a head unit 16, and a tank 12 including a subtank. The liquid ejection apparatus 10 may employ a serial head type or other types than the line head type.

The platen 11 is a flat plate member to receive thereon a sheet 14 and adjust a distance between the sheet 14 and the head unit 16. Herein, one side of the platen 11 toward the head unit 16 is referred to as an upper side, and the other side of the platen 11 away from the head unit 16 is referred to as a lower side. However, the liquid ejection apparatus 10 may be positioned in other orientations.

The transport unit may include two transport rollers 15 and a transport motor (not shown). The two transport rollers 15 are connected to the transport motor and disposed parallel to each other in a direction (an orthogonal direction) orthogonal to a transport direction of the sheet 14 while interposing the platen 11 therebetween. When the transport motor is driven, the transport rollers 15 rotate to transport the sheet 14 on the platen 11 in the transport direction.

The head unit 16 has a length greater than or equal to the length of the sheet 14 in the orthogonal direction. The head unit 16 includes a plurality of liquid ejection heads 20.

Each liquid ejection head 20 includes a stack structure including a channel unit and a volume changer. The channel unit includes liquid channels formed therein and a plurality of nozzle holes 21*a* open on an ejection surface (a nozzle surface) 40*a*. The volume changer is driven to change the volume of a liquid channel. In this case, a meniscus in a nozzle hole 21*a* vibrates and liquid is ejected from the nozzle hole 21*a*. The ink ejection head 20 will be described in detail later.

Separate tanks 12 are provided for different kinds of inks which are examples of liquids. For example, each of four tanks 12 stores therein a corresponding one of black, yellow, cyan, and magenta inks. Inks of the tanks 12 are supplied to corresponding nozzle holes 21*a*.

<Structure of Liquid Ejection Head>

Figure 2:
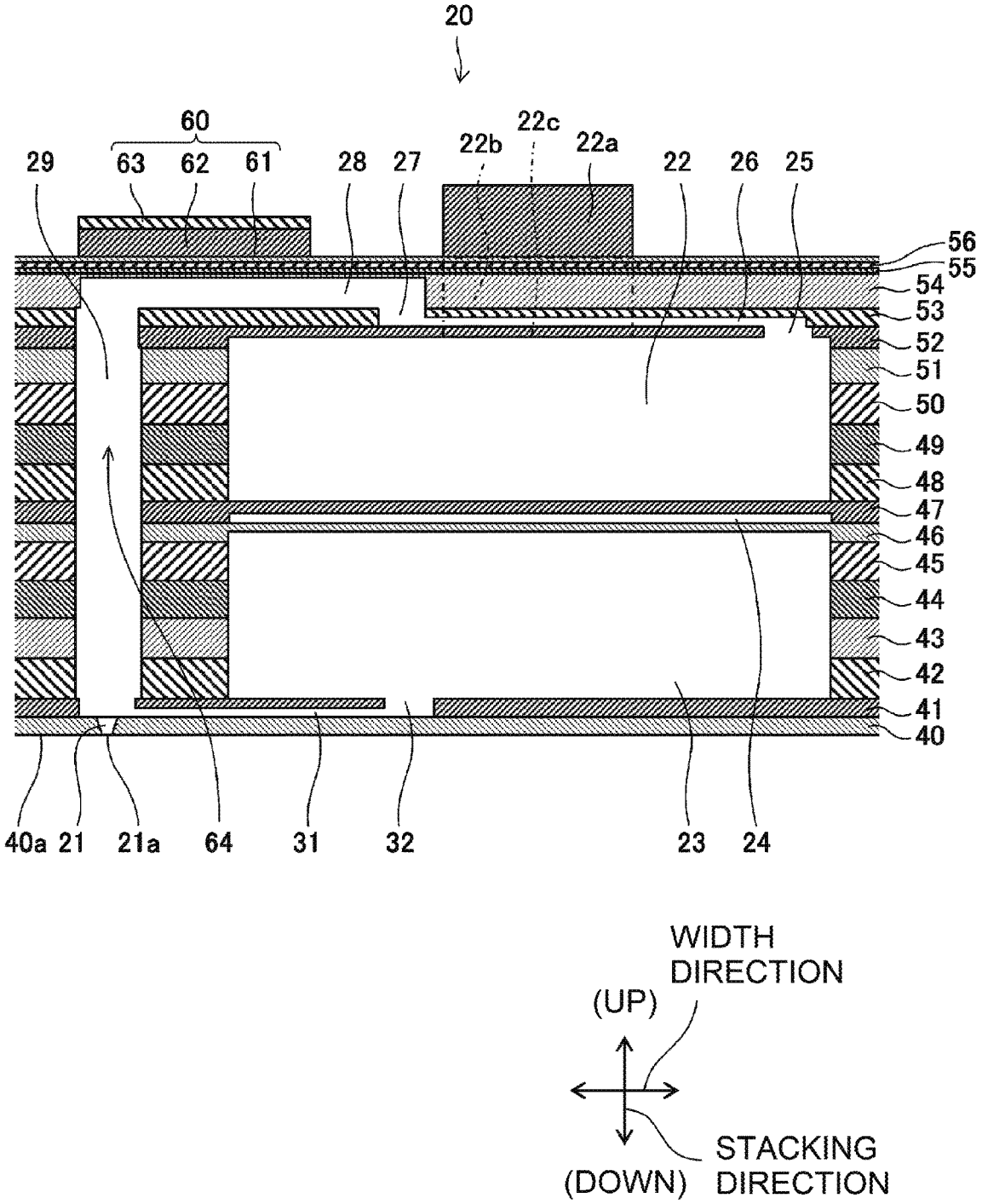
FIG. 2 is a cross-sectional view of the liquid ejection head of FIG. 1 taken along a line orthogonal to an extending direction.

As described above, each liquid ejection head 20 includes the channel unit and the volume changer. As shown in FIG. 2, the channel unit is formed by a stack of a plurality of plates (e.g., metal plates) and the volume changer includes a vibration plate 55 and piezoelectric elements 60.

The plurality of plates include a nozzle plate 40, a first channel plate 41, a second channel plate 42, a third channel plate 43, a fourth channel plate 44, a fifth channel plate 45, a sixth channel plate 46, a seventh channel plate 47, an eighth channel plate 48, a ninth channel plate 49, a 10th channel plate 50, an 11th channel plate 51, a 12th channel plate 52, a 13th channel plate 53, and a 14th channel plate 54. These plates are stacked in this order.

Each plate has holes and grooves of various sizes. A combination of holes and grooves in the stacked plates of the channel unit defines liquid channels such as a plurality of nozzles 21, a plurality of individual channels, a supply manifold 22, and a return manifold 23.

The nozzles 21 are formed to penetrate the nozzle plate 40 in a stacking direction (an up-down direction). Nozzle holes 21*a*, which are ends of the nozzles 21, are arranged as a nozzle array in a predetermined direction (hereinafter referred to as an extending direction) on the ejection surface 40*a* of the nozzle plate 40. The extending direction is orthogonal to the stacking direction and a width direction to be described later.

The supply manifold 22 extends in the extending direction and is connected to each individual channel 64. The return manifold 23 extends in the extending direction and is connected to each individual channel 64. The supply manifold 22 is at least partially stacked on the return manifold 23. Thus, the supply manifold 22 and the return manifold 23 at least partially overlap each other in plan view.

Figure 3:
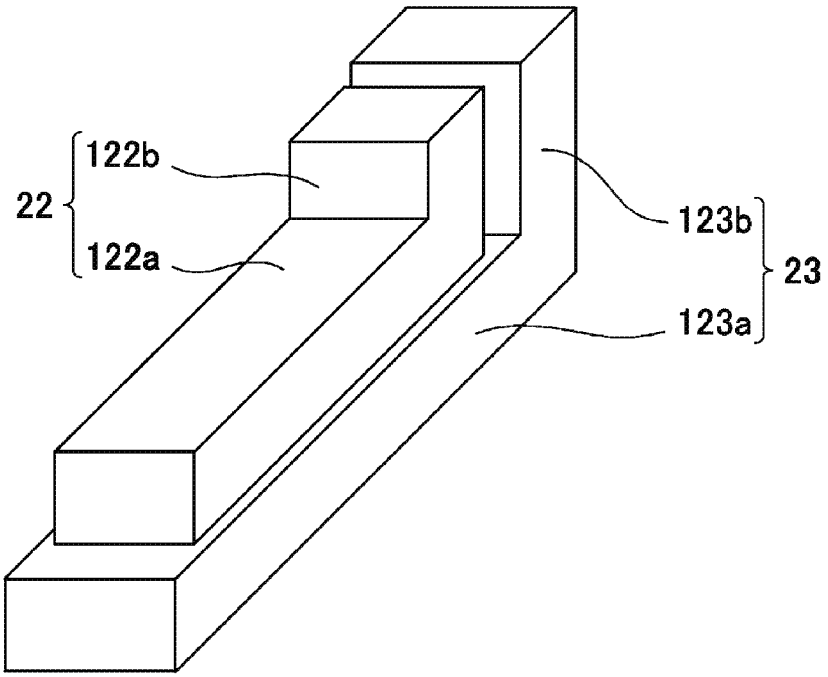
FIG. 3 is a perspective view showing the overall shapes of a supply manifold and a return manifold of the liquid ejection head.
Figure 3:
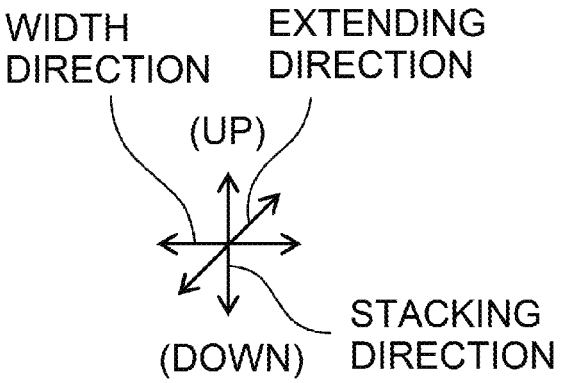

The overall shapes of the supply manifold 22 and the return manifold 23 will now be described. FIG. 3 is a perspective view showing the overall shapes of the supply manifold 22 and the return manifold 23. The supply manifold 22 and the return manifold 23 are hollow liquid channels which are shown by outlines in FIG. 3.

As shown in FIG. 3, in this embodiment, the supply manifold 22 and the return manifold 23 are L-shaped. The supply manifold 22 includes an extending portion 122*a* extending in the extending direction, and a standing portion 122*b* located at an end of the extending portion 122*a* and standing in the stacking direction. In this embodiment, the extending portion 122*a* and the standing portion 122*b* have the same width (length in the width direction).

The return manifold 23 includes a lower portion 123*a* and a standing portion 123*b*. In this embodiment, the lower portion 123*a* and the standing portion 123*b* have the same width.

The lower portion 123*a* of the return manifold 23 is located below the extending portion 122*a* of the supply manifold 22 so as to overlap the extending portion 122*a* of the supply manifold 22 in plan view. In other words, the extending portion 122*a* of the supply manifold 22 is located inside the lower portion 123*a* of the return manifold 23 in plan view. The lower portion 123*a* is slightly longer in the extending direction than the extending portion 122*a* so as to extend beyond one side (a side facing out of the page of FIG. 3) of the extending portion 122*a* in the extending direction. This improves the thermal insulation of the lower portion 123*a* as compared with when the lower portion 123*a* is as long as the extending portion 122*a*.

The standing portion 123*b* of the return manifold 23 is located, at one of opposite ends of the lower portion 123*a* in the extending direction, outside the standing portion 122*b* of the supply manifold 22 in plan view. The standing portion 122*b* of the supply manifold 22 is located inside the standing portion 123*b* of the return manifold 23 when viewed from the other side (a side facing into the page of FIG. 3) in the extending direction. In other words, the standing portion 122*b* is covered by the standing portion 123*b* when viewed from the other side in the extending direction.

Figure 6:
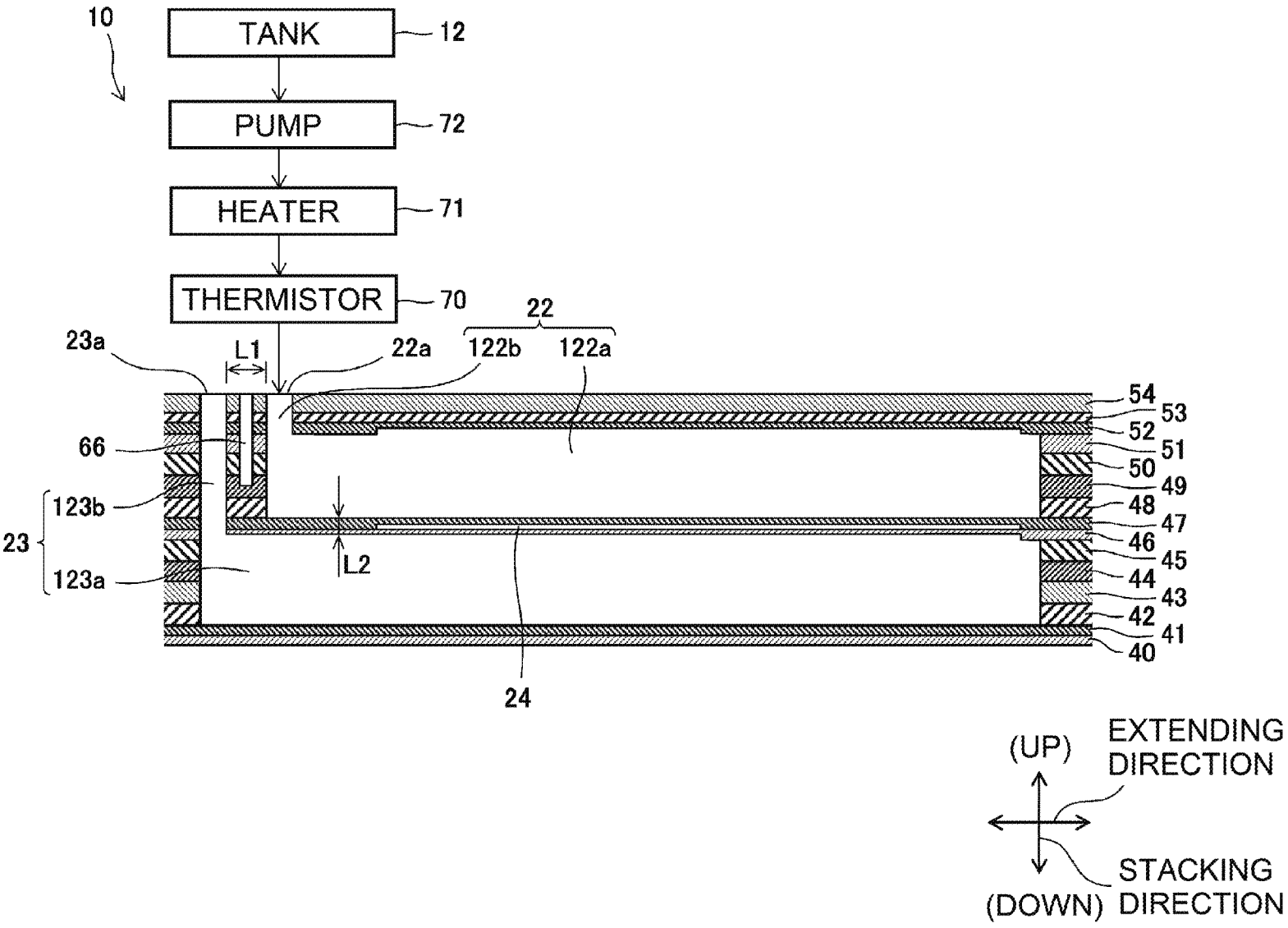
FIG. 6 is a cross-sectional view taken along line VI-VI in FIG. 5.

The extending portion 122*a* of the supply manifold 22 is formed by through-holes penetrating in the stacking direction the eighth channel plate 48 through the 11th channel plate 51, and a recess recessed from a lower surface of the 12th channel plate 52. The recess overlaps the through-holes in the stacking direction. A lower end of the supply manifold 22 is covered by the seventh channel plate 47, and an upper end of the supply manifold 22 is covered by an upper portion of the 12th channel plate 52. As shown in FIG. 6, the standing portion 122*b* of the supply manifold 22 is formed by through-holes penetrating in the stacking direction the eighth channel plate 48 through the 14th channel plate 54.

The lower portion 123*a* of the return manifold 23 is formed by through-holes penetrating in the stacking direction the second channel plate 42 through the fifth channel plate 45, and a recess recessed from a lower surface of the sixth channel plate 46. The recess overlaps the through-holes in the stacking direction. A lower end of the lower portion 123*a* of the return manifold 23 is covered by the first channel plate 41, and an upper end of lower portion 123*a* of the return manifold 23 is covered by an upper portion of the sixth channel plate 46. As shown in FIG. 6, the standing portion 123*b* of the return manifold 23 is formed by through-holes penetrating in the stacking direction the second channel plate 42 through the 14th channel plate 54.

The extending portion 122*a* of the supply manifold 22 and the lower portion 123*a* of the return manifold 23 define therebetween an air layer 24 as a buffer space. The air layer 24 is formed by a recess recessed from a lower surface of the seventh channel plate 47. In the stacking direction, the extending portion 122*a* of the supply manifold 22 and the air layer 24 are adjacent to each other via an upper portion of the seventh channel plate 47, and the lower portion 123*a* of the return manifold 23 and the air layer 24 are adjacent to each other via the upper portion of the sixth channel plate 46. The air layer 24 sandwiched between the extending portion 122*a* of the supply manifold 22 and the lower portion 123*a* of the return manifold 23 may reduce interaction between the liquid pressure in the extending portion 122*a* of the supply manifold 22 and the liquid pressure in the lower portion 123*a* of the return manifold 23.

An upper portion of the standing portion 122*b* of the supply manifold 22 includes a supply port 22*a* which may be tubular. An upper end of a supply passage 22*b* is connected to an inner space of the supply port 22*b*. The supply passage 22*b* extends downward from the supply port 22*a*. For example, the supply passage 22*b* penetrates an upper portion of the 12th channel plate 52, the 13th channel plate 53, the 14th channel plate 54, the vibration plate 55, and an insulating film 56. A lower end of the supply passage 22*b* is connected to the supply port 22*c* for the supply manifold 22.

Figure 4:
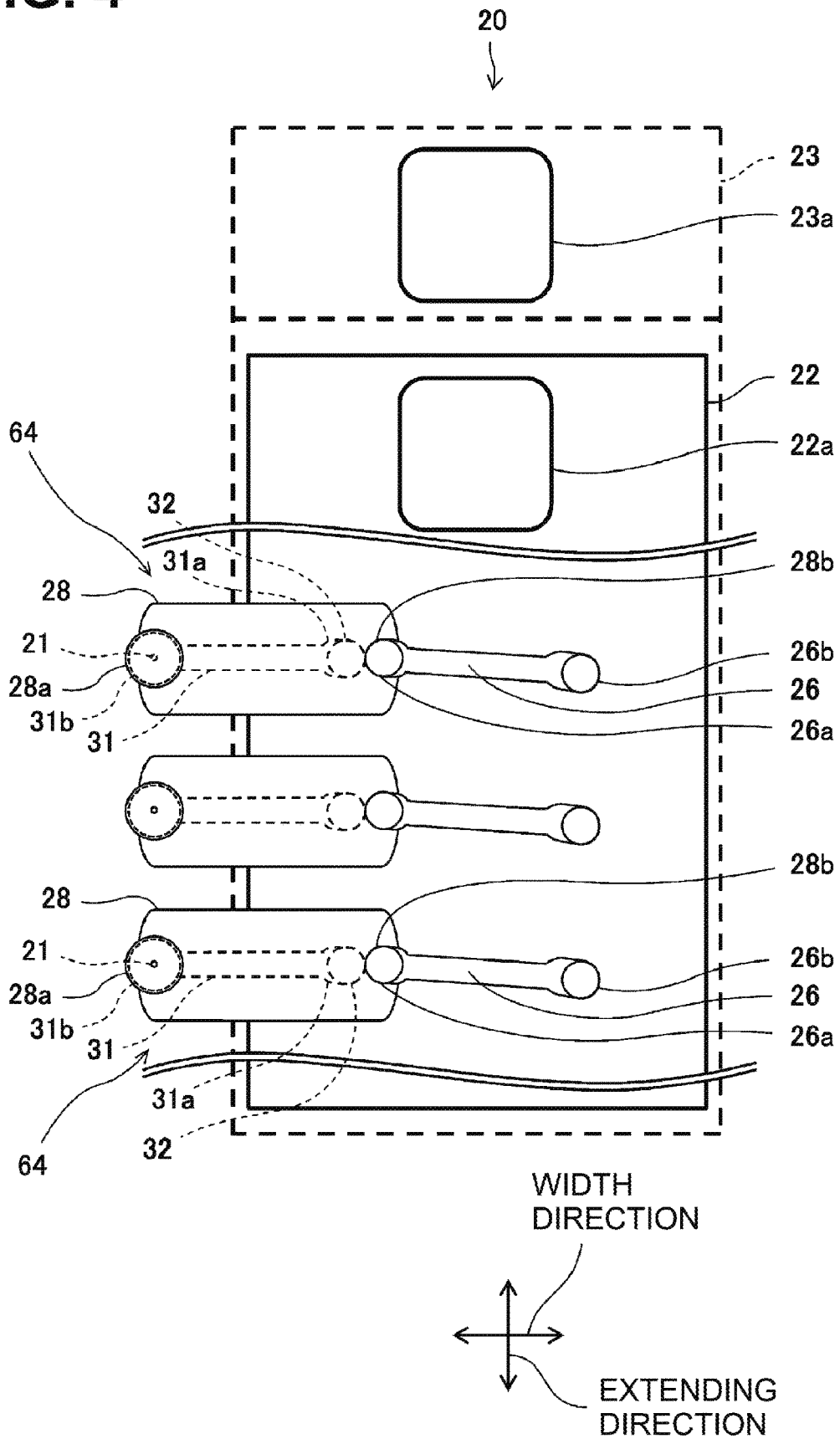
FIG. 4 is a plan view of the supply manifold, the return manifold, and individual channels of the liquid ejection head.

An upper portion of the standing portion 123*b* of the return manifold 23 includes a return port 23*a* which may be tubular. A lower end of a return passage (not shown) is connected to the return port 23*a*. The return passage extends upward from the return port 23*a*. For example, the return passage penetrates an upper portion of the 12th channel plate 52, the 13th channel plate 53, the 14th channel plate 54, the vibration plate 55, and the insulating film 56. The return port 23*a* is located further to one side (an upper side of the page of FIG. 4) in the extending direction than the supply port 22*a*.

As shown in FIG. 6, an anti-cooling space 66 is located between the supply port 22*a* and the return port 23*a* such that air flows into the anti-cooling space 66. The anti-cooling space 66 is formed by holes in the ninth channel plate 49, the 10th channel plate 50, the 11th channel plate 51, the 12th channel plate 52, the 13th channel plate 53, and the 14th channel plate 54 which overlap in the stacking direction. The depth (the length in the stacking direction) of the anti-cooling space 66 may be changed as required. The vibration plate 55, the insulating film 56, and the piezoelectric elements 60 are omitted from FIG. 6.

In addition to the above-described tank 12, the liquid ejection apparatus 10 further includes a thermistor 70, a heater 71, and a pump 72. The thermistor 70, the heater 71, the pump 72, and the tank 12 are disposed upstream of the liquid ejection head 20. The tank 12 is disposed upstream of the pump 72 which is disposed upstream of the heater 71 which is disposed upstream of the thermistor 70. After the pump 72 draws liquid stored in the tank 12, the liquid is heated by the heater 71 to a predetermined temperature and is supplied to the supply port 22*a*. Before the liquid is supplied to the supply port 22*a*, the thermistor 70 detects the temperature of the liquid. Based on the liquid temperature detected by the thermistor 70, a drive voltage for a piezoelectric element 60, which applies ejection energy to liquid in a corresponding pressure chamber 28, is controlled.

In FIG. 6, a distance L1 between the supply port 22*a* and the return port 23*a* in the extending direction is set to be greater than a distance L2 between the extending portion 122*a* of the supply manifold 22 and the lower portion 123*a* of the return manifold 23 in the stacking direction. For ease of comprehension, in FIG. 6, the scale of dimensions in the stacking direction is 10 times greater than that in the extending direction.

Referring back to FIG. 2, the plurality of individual channels 64 are connected to the supply manifold 22 and to the return manifold 23. Each individual channel 64 is connected, at its upstream end, to the supply manifold 22, connected, at its downstream end, to the return manifold 23, and connected, at its midstream, to a base end of a corresponding nozzle 21. Each individual channel 64 includes a first communication hole 25, a supply throttle channel 26, a second communication hole 27, a pressure chamber 28, a descender 29, a return throttle channel 31, and a third communication hole 32, which are arranged in this order.

The first communication hole 25 is connected, at its lower end, to an upper end of the supply manifold 22, and extends upward from the supply manifold 22 in the stacking direction to penetrate an upper portion of the 12th channel plate 52 in the stacking direction. The first communication hole 25 is offset to one side (a right side in FIG. 2) from a center of the supply manifold 22 in the width direction.

One end 26*b* (refer to FIG. 4) of the supply throttle channel 26 is connected to an upper end of the first communication hole 25. The supply throttle channel 26 is formed, for example, by half-etching, as a groove recessed from a lower surface of the 13th channel plate 53. The supply throttle channel 26 is located to cross the width direction in plan view. The second communication hole 27 is connected, at its lower end, to the other end 26*a* (refer to FIG. 4) of the supply throttle channel 26, and extends from the supply throttle channel 26 upward in the stacking direction to penetrate an upper portion of the 13th channel plate 53 in the stacking direction. The second communication hole 27 is offset to the other side (a left side in FIG. 2) from the center of the supply manifold 22 in the width direction.

The pressure chamber 28 is connected, at its one end 28*b* (refer to FIG. 4), to an upper end of the second communication hole 27. The pressure chamber 28 penetrates the 14th channel plate 54 in the stacking direction.

The descender 29 penetrates the first channel plate 41 through the 13th channel plate 53 in the stacking direction and is located further to the other side (the left side in FIG. 2) in the width direction than the supply manifold 22 and the return manifold 23. The descender 29 is connected, at its upper end, to the other end 28*a* (refer to FIG. 4) of the pressure chamber 28, and is connected, at its lower end, to the nozzle 21. For example, the nozzle 21 is located to overlap the descender 29 in the stacking direction and is located at a center of the descender 29 in a direction orthogonal to the stacking direction. The descender 29 may have a cross-sectional area which is uniform or varies in the stacking direction.

The return throttle channel 31 is connected, at its one end 31*b* (refer to FIG. 4), to a lower end of the descender 29. The return throttle channel 31 is formed, for example, by half-etching, as a groove recessed from a lower surface of the first channel plate 41.

The third communication hole 32 is connected, at its lower end, to the other end 31*a* (refer to FIG. 4) of the return throttle channel 31 and extends from the return throttle channel 31 upward in the stacking direction to penetrate an upper portion of the first channel plate 41 in the stacking direction. The third communication hole 32 is connected to a lower end of the return manifold 23. The third communication hole 32 is offset to the other side (the left side in FIG. 2) from the center of the return manifold 23 in the width direction.

The vibration plate 55 is stacked on the 14th channel plate 54 to cover upper openings of the pressure chambers 28. The vibration plate 55 may be integral with the 14th channel plate 54. In this case, each pressure chamber 28 is recessed from a lower surface of the 14th channel plate 54 in the stacking direction. An upper portion of the 14th channel plate 54, which is above each pressure chamber 28, functions as the vibration plate 55.

Each piezoelectric element 60 includes a common electrode 61, a piezoelectric layer 62, and an individual electrode 63 which are arranged in this order. The common electrode 61 entirely covers the vibration plate 55 via the insulating film 56. Each piezoelectric layer 62 is located on the common electrode 61 to overlap a corresponding pressure chamber 28. Each individual electrode 63 is provided for a corresponding pressure chamber 28 and is located on a corresponding piezoelectric layer 62. In this case, a piezoelectric element 60 is formed by an active portion of a piezoelectric layer 62, which is sandwiched by an individual electrode 63 and the common electrode 61.

Each individual electrode 63 is electrically connected to a driver IC. The driver IC receives control signals from a controller (not shown) and generates drive signals (voltage signals) selectively to the individual electrodes 63. In contrast, the common electrode 61 is constantly maintained at a ground potential.

In response to a drive signal, an active portion of each selected piezoelectric layer 62 expands and contracts in a surface direction, together with the two electrodes 61 and 63. Accordingly, the vibration plate 55 corporates to deform to increase and decrease the volume of a corresponding pressure chamber 28. A pressure for liquid ejection from a nozzle 21 is applied to the corresponding pressure chamber 28 depending on its volume.

Figure 5:
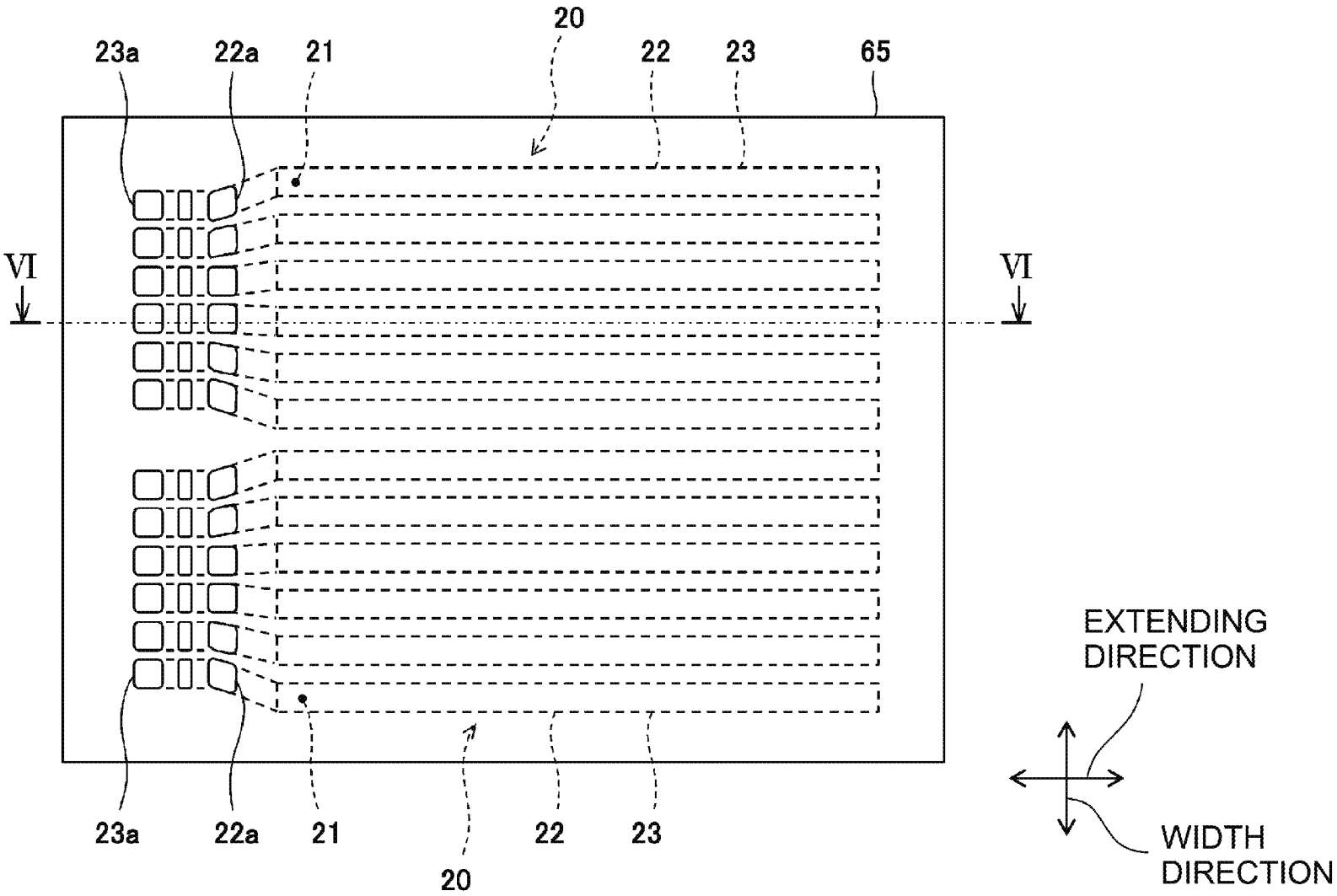
FIG. 5 is a plan view of a frame where the liquid ejection head is mounted in plural numbers.

Next, FIG. 5 is a plan view of a frame 65 where the liquid ejection head 20 according to the first illustrative embodiment is mounted in plural numbers.

As shown in FIG. 5, a plurality of liquid ejection heads 20 are arranged to each extend along the extending direction. As described while referring to FIG. 4, each liquid ejection head 20 includes a supply port 22*a* and a return port 23*a* on its one side (a left side in FIG. 5). Each supply manifold 22 has a supply port 22*a*, and each return manifold 23 has a return port 23*a*.

Each supply port 22*a* and each return port 23*a* are located closer to a center of the liquid ejection heads 20 in the width direction than the supply and return manifolds 22 and 23 positioned at one end and the supply and return manifolds 22 and 23 positioned at the other end of the liquid ejection heads 20 in the width direction. Specifically, at least a portion of each supply port 22*a* and at least a portion of each return port 23*a* are located, in the width direction, between a nozzle 21 positioned at one end (an upper end in FIG. 5) of the liquid ejection heads 20 in the width direction and a nozzle 21 positioned at the other end (a lower end in FIG. 5) of the liquid ejection heads 20 in the width direction. In addition, at least a portion of each supply port 22*a* and at least a portion of a corresponding return port 23*a* are located to overlap each other when viewed in the extending direction.

<Liquid Flow>

Flow of liquid, such as ink, in the ink ejection head 20 in this embodiment will be described. The supply port 22*a* is connected to the tank 12 via a supply conduit (not shown), and the return port 23*a* is connected to the tank 12 via a return conduit (not shown). In this structure, when the pump 72 in the supply conduit and a negative-pressure pump (not shown) in the return conduit are driven, liquid from the tank 12 passes through the supply conduit into the supply manifold 22, via the supply port 22*a*.

Meanwhile, liquid partially flows into the individual channels 64. In each individual channel 64, liquid flows from the supply manifold 22, via the first communication hole 25, into the supply throttle channel 26 and further flows from the supply throttle channel 26, via the second communication hole 27, into the pressure chamber 28. Then, liquid flows from an upper end to a lower end of the descender 29 in the stacking direction to enter the nozzle 21. When the piezoelectric element 60 applies an ejection pressure to the pressure chamber 28, liquid is ejected from the nozzle hole 21*a*.

A part of liquid having not been ejected from the nozzle hole 21*a* flows through the return throttle channels 31 and enter the return manifold 23 via the third communication holes 32. Liquid entering the return manifold 23 via the third communication hole 32 flows through the return manifold 23, exits from the return port 23*a* to an exterior, and returns, via the return conduit, to the tank 12. Thus, liquid having not been ejected from the nozzle holes 21*a* circulates between the tank 12 and the individual channels 64.

In the liquid ejection head 20 according to the above-described embodiment, the lower portion 123*a* and the standing portion 123*b* of the return manifold 23, which are L-shaped, covers the supply manifold 22, thereby reducing, more than before, an area of the supply manifold 22 exposed to open air. This may prevent, more than before, cooling of liquid when it flows through the supply manifold 22 and reaches the pressure chambers 28. There is less of a difference between the temperature detected by the thermistor 70 and the temperature of liquid flowing into the pressure chambers 28. This allows control of a drive voltage for the piezoelectric elements 60 based on the temperature detected by the thermistor 70 which is close to the actual temperature of liquid. Thus, liquid ejection failures may be reduced.

In this embodiment, the standing portion 123*b* of the return manifold 23 has a width greater than the width in the width direction of the standing portion 122*b* of the supply manifold 22. Thus, the standing portion 123*b* of the return manifold 23 largely covers the standing portion 122*b* of the supply manifold 22. In other words, the standing portion 123*b* largely guards the standing portion 122*b* from an external space, thereby preventing cooling of liquid in the supply manifold 22.

In this embodiment, the supply manifold 22 and the return manifold 23 define the air layer 24 therebetween. The provision of the air layer 24, which has a lower thermal conductivity than metal, may further prevent cooling of liquid in the supply manifold 22.

In this embodiment, the individual channels 64 are formed in the metal plates in which channels are readily formed but which tend to cool off because of its high thermal conductivity. However, the lower portion 123*a* and the standing portion 123*b* of the return manifold 23, which are L-shaped, cover the supply manifold 22, thereby reducing the tendency of liquid to cool off.

In this embodiment, the distance L1 between the supply port 22*a* and the return port 23*a* in the extending direction is set to be greater than the distance L2 between the extending portion 122*a* of the supply manifold 22 and the lower portion 123*a* of the return manifold 23 in the stacking direction. This increases the thickness (in the extending direction) of a partition wall between the supply port 22*a* and the return port 23*a*. Thus, the supply port 22*a* and the return port 23*a* are readily formed and the anti-cooling space 66 is increased in volume.

In this embodiment, the supply port 22*a* and the return port 23*a* define therebetween the anti-cooling space 66 into which air flows. The provision of the anti-cooling space 66, which is filled with air having a low thermal conductivity, may further prevent cooling of liquid in the supply manifold 22.

At least a portion of each supply port 22*a* and at least a portion of each return port 23*a* are located, in the width direction, between the nozzle 21 positioned at one end (the upper end in FIG. 5) of the liquid ejection heads 20 and the nozzle 21 positioned at the other end (the lower end in FIG. 5) of the liquid ejection heads 20. Each supply port 22*a* and each return port 23*a* are located closer to the center of the liquid ejection heads 20 in the width direction than the supply and return manifolds 22 and 23 positioned at one end and the supply and return manifolds 22 and 23 positioned at the other end of the liquid ejection heads 20 in the width direction. Thus, liquid in each supply manifold 22 is unlikely to cool off.

Furthermore, in this embodiment, at least a portion of each supply port 22*a* and at least a portion of a corresponding return port 23*a* are located to overlap each other when viewed in the extending direction. This allows each supply manifold 22 to be covered by a corresponding return manifold 23 reduced in size.

Second Illustrative Embodiment

Figure 7:
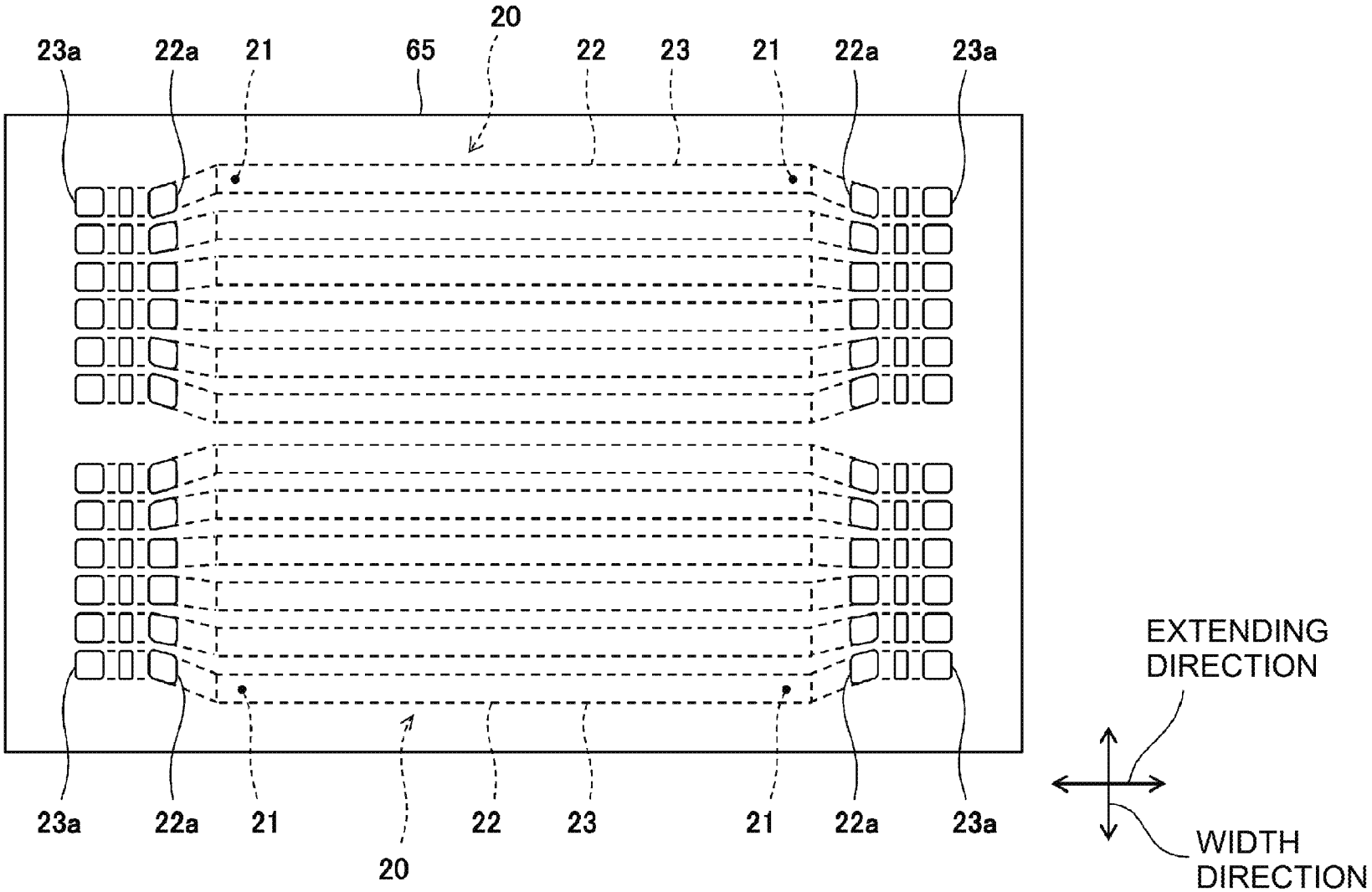
FIG. 7 is a plan view of a frame where a liquid ejection head according to a second illustrative embodiment is mounted in plural numbers.

In the above-described first illustrative embodiment, the supply manifold 22 include the supply port 22*a* on its one side in the extending direction, and the return manifold 23 includes the return port 23*a* on its one side in the extending direction. However, as shown in FIG. 7, each of supply manifolds 222 may include a supply port 22*a* on its one side (a left side in FIG. 7) and another supply port 22*a* on its other side (a right side in FIG. 7). Each of return manifolds 223 may include a return port 23*a* on its one side (the left side in FIG. 7) and another return port 23*a* on its other side (the right side in FIG. 7). In this case, also, each supply port 22*a* and each return port 23*a* on the other side in the extending direction are located closer to a center of liquid ejection heads 20 in a width direction than the supply and return manifolds 222 and 223 positioned at one end and the supply and return manifolds 222 and 223 positioned at the other end of the liquid ejection heads 20 in the width direction. Specifically, at least a portion of each supply port 22*a* and at least a portion of each return port 23*a* are located, in the width direction, between a nozzle 21 positioned at one end (an upper end in FIG. 7) of the liquid ejection heads 20 and a nozzle 21 positioned at the other end (a lower end in FIG. 7) of the liquid ejection heads 20. In addition, at least a portion of each supply port 22*a* and at least a portion of a corresponding return port 23*a* are located to overlap each other when viewed in the extending direction.

In the first illustrative embodiment, the lower portion 123*a* and the standing portion 123*b* of the return manifold 23, which are L-shaped, cover the supply manifold 22. However, in the second illustrative embodiment, the supply manifold 222 and the return manifold 223 may be shaped as described below.

Figure 8:
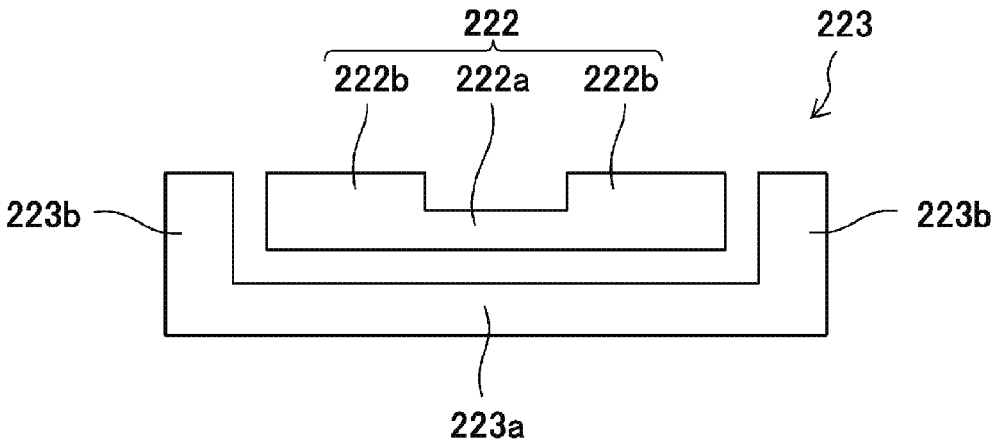
FIG. 8 is a side view showing the shapes of a supply manifold and a return manifold of the liquid ejection head according to the second illustrative embodiment.
Figure 8:
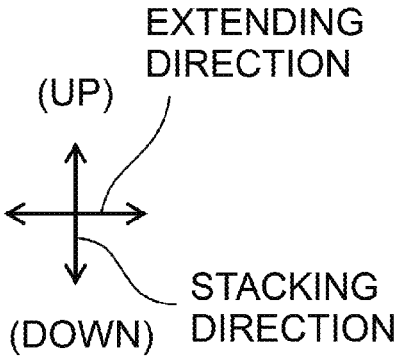

In the second embodiment, as shown in FIG. 8, the supply manifold 222 includes an extending portion 222*a* extending in the extending direction and standing portions 222*b* each standing at a corresponding one of opposite ends of the extending portion 222*a* in the extending direction.

The return manifold 223 includes a lower portion 223*a* located below the extending portion 222*a* of the supply manifold 222 to extend in the extending direction, and standing portions 223*b* standing at opposite ends of the extending portion 223*a* in the extending direction.

In the liquid ejection head 20 according to this embodiment, the return manifold 223, including the lower portion 223*a* and the standing portions 223*b* opposite to each other in the extending direction, is U-shaped and covers the supply manifold 222, thereby reducing, more than before, an area of the supply manifold 222 exposed to open air. This may prevent, more than before, cooling of liquid when it flows through the supply manifold 222 and reaches pressure chambers 28. There is less of a difference between the temperature detected by a thermistor 70 and the temperature of liquid flowing into the pressure chambers 28. This allows control of a drive voltage for piezoelectric elements 60 based on the temperature detected by the thermistor 70 which is close to the actual temperature of liquid. Thus, liquid ejection failures may be reduced.

Modifications

The disclosure may not be limited to the above-described embodiments, and various changes may be applied therein without departing from the spirit and scope of the disclosure.

Figure 9:
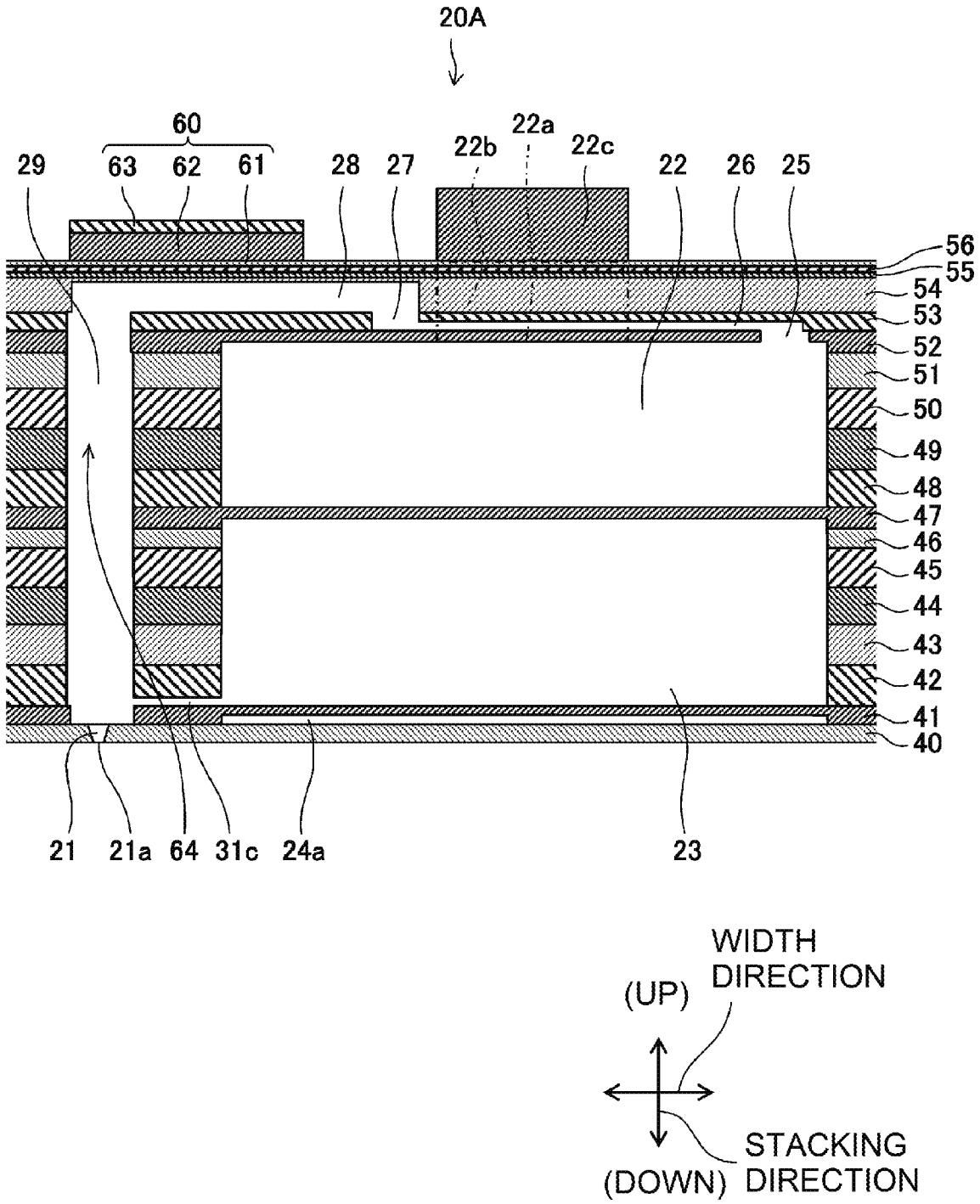
FIG. 9 is a cross-sectional view of a modified liquid ejection head taken along a line orthogonal to an extending direction.

For example, as shown in FIG. 9, a liquid ejection head 20A may include an air layer 24*a* defined between a nozzle plate 40 with nozzles 21 and a return manifold 23, in place of the air layer 24 in FIG. 2. The provision of the air layer 24*a*, which has a low thermal conductivity, may further prevent cooling of liquid in a supply manifold 22. The liquid ejection head 20A includes a return throttle channel 31*c* formed by, for example, half-etching a second channel plate 42.

Figure 10:
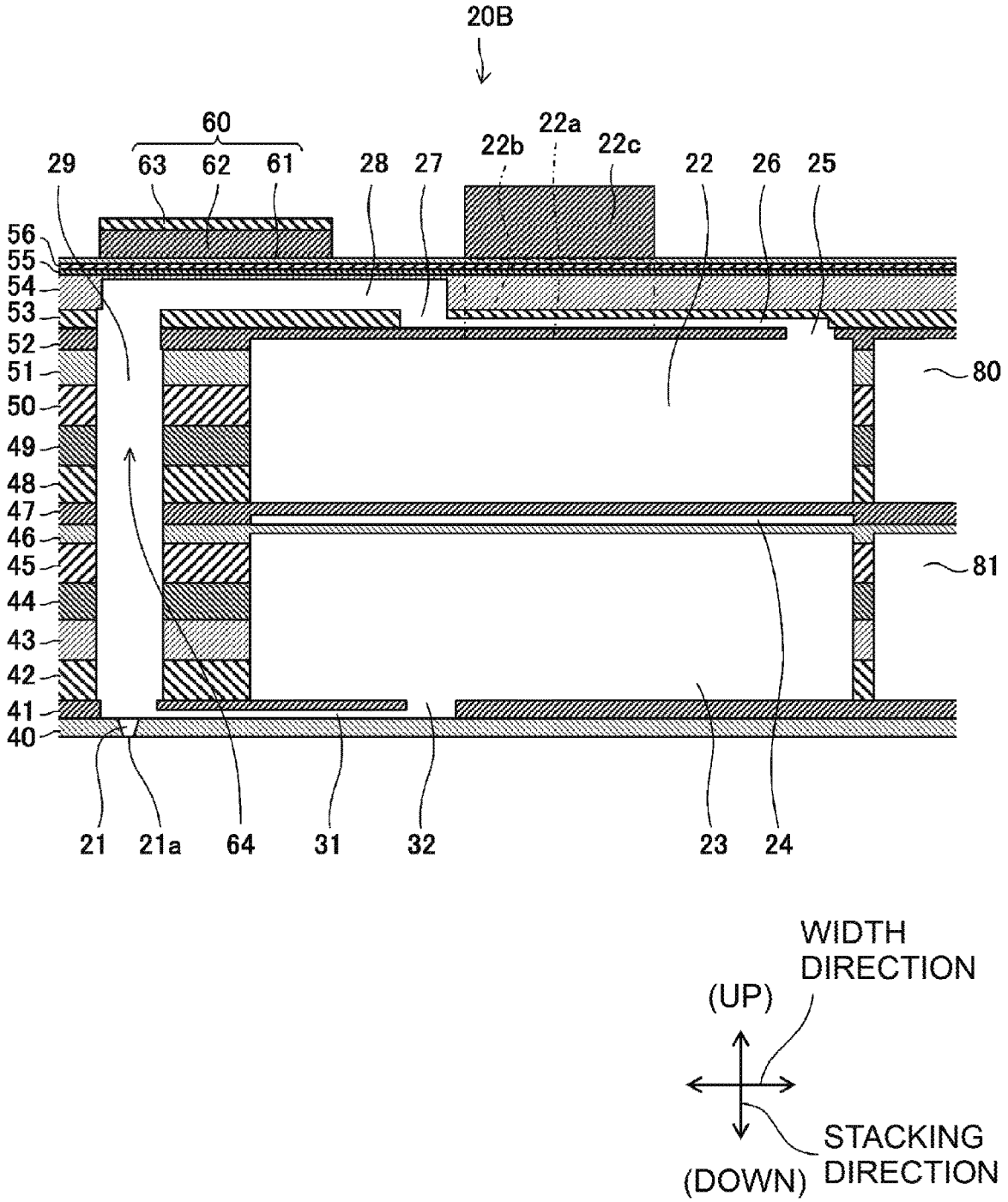
FIG. 10 is a cross-sectional view of a modified liquid ejection head taken along a line orthogonal to an extending direction.

As shown in FIG. 10, a liquid ejection head 20B may include, on a side (a right side in FIG. 10) of a supply manifold 22 and return manifold 23, a dummy supply manifold 80 including a supply port through which liquid is supplied from an exterior, and a dummy return manifold 81 including a return port through which liquid is discharged to the exterior. The dummy supply manifold 80 is formed by through-holes penetrating an eighth channel plate 48 through an 11th channel plate 51 in a stacking direction, and a recess recessed from a lower surface of a 12th channel plate 52. The recess overlaps the through-holes in the stacking direction. The dummy return manifold 81 is formed by through-holes penetrating a second channel plate 42 through a fifth channel plate 45 in the second channel, and a recess recessed from a lower surface of a sixth channel plate 46. The recess overlaps the through-holes in the stacking direction. Air in the dummy supply manifold 80 and the dummy return manifold 81 which are provided in the liquid ejection head 20 may further prevent cooling of liquid, such as ink, flowing to pressure chambers 28.

In the above-described first illustrative embodiment, the supply manifold 22 is L-shaped but not so limited. The supply manifold 22 may only consist of the extending portion 122*a*.

In the above-described first illustrative embodiment, in plan view, the extending portion 122*a* of the supply manifold 22 is positioned within the lower portion 123*a* of the return manifold 23, and the one side (the side facing out of the page of FIG. 3) of the lower portion 123*a* extends beyond the extending portion 122*a* in the extending direction. However, the extending portion 122*a* of the supply manifold 22 may have the same width as the lower portion 123*a* of the return manifold 23. An end face of one side of the extending portion 122*a* in the extending direction may be flush with an end face of one side of the lower portion 123*a* in the extending direction.

What is claimed is:

1. A liquid ejection head comprising:

a supply manifold including a supply port through which liquid is supplied from an exterior;

a return manifold including a return port through which liquid is discharged to the exterior; and a plurality of individual channels each connected, at an upstream end thereof, to the supply manifold and, at a downstream end thereof, to the return manifold, each of the individual channels communicating with a corresponding one of nozzles arranged in an array on a nozzle surface, wherein the supply manifold and the return manifold extend in an extending direction along the array of the nozzles, wherein the return manifold includes:

a lower portion located below the supply manifold to overlap the supply manifold in plan view orthogonal to the nozzle surface, and a standing portion located at at least one of opposite ends of the lower portion in the extending direction to be outside the supply manifold in plan view, the standing portion having a height to cover at least a portion of an end of the supply manifold when viewed in the extending direction, and wherein a distance in the extending direction between the supply port and the return port is greater than a distance in a vertical direction between the supply manifold and the lower portion of the return manifold.

2. The liquid ejection head according to claim 1, wherein the standing portion has a width greater than a width of the end of the supply manifold in a direction orthogonal to the extending direction.

3. The liquid ejection head according to claim 1, wherein the supply manifold and the return manifold define an air layer therebetween.

4. The liquid ejection head according to claim 1, further comprising a plate having through-holes as the nozzles, wherein the return manifold and the plate define an air layer therebetween.

5. The liquid ejection head according to claim 1, wherein the plurality of individual channels are formed in metal plates.

6. The liquid ejection head according to claim 1, further comprising:

a dummy supply manifold including a supply port through which liquid is supplied form the exterior; and a dummy return manifold including a return port through which liquid is discharged to the exterior, wherein the dummy supply manifold and the dummy return manifold are located on a side of the supply manifold and the return manifold in a direction orthogonal to the extending direction.

7. The liquid ejection head according to claim 1, wherein the return port is located at at least one of opposite ends of the return manifold in the extending direction.

8. The liquid ejection head according to claim 1, wherein the supply port is located at each of opposite ends of the supply manifold in the extending direction.

9. The liquid ejection head according to claim 1, wherein the supply port and the return port define therebetween an air space into which air flows.

10. The liquid ejection head according to claim 1, wherein at least a portion of the supply port and at least a portion of the return port overlap each other when viewed in the extending direction.

11. A liquid ejection apparatus comprising:

the liquid ejection head according to claim 1; and a thermistor disposed upstream of the liquid ejection head and configured to detect a temperature of liquid.

12. The liquid ejection apparatus according to claim 11, further comprising a heater disposed upstream of the thermistor and configured to heat liquid.

13. A liquid ejection head comprising:

a supply manifold including a supply port through which liquid is supplied from an exterior;

a return manifold including a return port through which liquid is discharged to the exterior; and a plurality of individual channels each connected, at an upstream end thereof, to the supply manifold and, at a downstream end thereof, to the return manifold, each of the individual channels communicating with a corresponding one of nozzles arranged in an array on a nozzle surface, wherein the supply manifold and the return manifold extend in an extending direction along the array of the nozzles, wherein the return manifold includes:

a lower portion located below the supply manifold to overlap the supply manifold in plan view orthogonal to the nozzle surface, and a standing portion located at at least one of opposite ends of the lower portion in the extending direction to be outside the supply manifold in plan view, the standing portion having a height to cover at least a portion of an end of the supply manifold when viewed in the extending direction, and wherein the liquid ejection head is arranged in plural numbers such that the supply port and the return port of each of the liquid ejection heads are located, in an orthogonal direction orthogonal to the extending direction, between a nozzle positioned at one end and a nozzle positioned at the other end of the liquid ejection heads in the orthogonal direction.

14. The liquid ejection head according to claim 13, wherein the standing portion has a width greater than a width of the end of the supply manifold in a direction orthogonal to the extending direction.

15. The liquid ejection head according to claim 13, wherein the supply manifold and the return manifold define an air layer therebetween.

16. The liquid ejection head according to claim 13, wherein the return port is located at at least one of opposite ends of the return manifold in the extending direction.

17. The liquid ejection head according to claim 13, wherein the supply port is located at each of opposite ends of the supply manifold in the extending direction.

18. The liquid ejection head according to claim 13, wherein at least a portion of the supply port and at least a portion of the return port overlap each other when viewed in the extending direction.

19. A liquid ejection apparatus comprising:

the liquid ejection head according to claim 13; and a thermistor disposed upstream of the liquid ejection head and configured to detect a temperature of liquid.

20. The liquid ejection apparatus according to claim 19, further comprising a heater disposed upstream of the thermistor and configured to heat liquid.

* * * * *